US010557670B2

(12) United States Patent
Sægrov et al.

(10) Patent No.: US 10,557,670 B2
(45) Date of Patent: Feb. 11, 2020

(54) DEVICE FOR HEAT EXCHANGE

(71) Applicant: Pleat AS, Stavanger (NO)

(72) Inventors: Stein Oddvar Sægrov, Stavanger (NO); Otto Godeset, Stavanger (NO)

(73) Assignee: Pleat AS, Stavanger (NO)

( * ) Notice: Subject to any disclaimer, the term of this patent is extended or adjusted under 35 U.S.C. 154(b) by 238 days.

(21) Appl. No.: 15/314,794

(22) PCT Filed: May 29, 2015

(86) PCT No.: PCT/IB2015/054070
§ 371 (c)(1),
(2) Date: Nov. 29, 2016

(87) PCT Pub. No.: WO2015/181795
PCT Pub. Date: Dec. 3, 2015

(65) Prior Publication Data

US 2017/0234621 A1 Aug. 17, 2017

(30) Foreign Application Priority Data

May 30, 2014 (NO) ..... 20140674

(51) Int. Cl.
*F28D 9/00* (2006.01)
*F28F 9/00* (2006.01)
*F28D 21/00* (2006.01)

(52) U.S. Cl.
CPC ..... *F28D 9/0025* (2013.01); *F28F 9/001* (2013.01); *F28D 2021/0066* (2013.01)

(58) Field of Classification Search
CPC ..... F28D 9/0025; F28D 2021/0066; F28D 2021/0061; F28F 9/001
See application file for complete search history.

(56) References Cited

U.S. PATENT DOCUMENTS 1,597,678 A 8/1926 Fisher
3,732,919 A * 5/1973 Wilson ..... F16L 9/00 165/110
3,810,509 A * 5/1974 Kun ..... B21D 22/04 165/148
4,384,611 A * 5/1983 Fung ..... F28D 9/0025 165/166

(Continued)

FOREIGN PATENT DOCUMENTS

CN 1462356 A 12/2003
DE 3041493 A1 6/1982

(Continued)

OTHER PUBLICATIONS

International Search Report issued in PCT/IB2015/054070 dated Sep. 18, 2015 (2 pages).

(Continued)

*Primary Examiner* — Ljiljana V. Ciric
(74) *Attorney, Agent, or Firm* — Osha Liang LLP

(57) ABSTRACT

A sheet material is used for a heat exchange between a first fluid and a second fluid, and inducing a phase change in the fluids. Additionally, the sheet material is folded to form a plurality of slits to constitute flow paths of the fluids. Further, the slits for the first fluid, through at least one seal, are closed. Furthermore, the slits for the second fluid, through at least one seal, are fully or partly open for fluid outflow.

5 Claims, 10 Drawing Sheets

(56) References Cited

U.S. PATENT DOCUMENTS

| | | | | |
|---|---|---|---|---|
| 4,585,523 | A * | 4/1986 | Giddings | B01D 1/22 159/13.1 |
| 5,282,507 | A * | 2/1994 | Tongu | F25B 15/02 165/165 |
| 5,770,020 | A * | 6/1998 | Koistinen | B01D 1/22 159/13.3 |
| 6,059,023 | A * | 5/2000 | Kurematsu | B23P 15/26 165/165 |
| 6,186,223 | B1 * | 2/2001 | Bergh | B01J 19/0093 165/157 |
| 6,590,770 | B1 * | 7/2003 | Rogers | H01L 23/3672 165/121 |
| 6,723,262 | B2 * | 4/2004 | Hidaka | B01J 35/04 264/40.5 |
| 7,591,301 | B2 * | 9/2009 | Whittenberger | B01J 19/249 165/164 |
| 7,594,326 | B2 * | 9/2009 | Whittenberger | B01J 12/007 165/157 |
| 7,661,415 | B2 * | 2/2010 | Nakamura | F28D 9/0025 123/568.12 |
| 7,669,645 | B2 * | 3/2010 | Nakamura | F28D 9/0025 165/157 |
| 8,047,272 | B2 * | 11/2011 | Whittenberger | B21D 53/02 165/133 |
| 9,562,726 | B1 * | 2/2017 | Eplee | F28D 21/0015 |
| 2002/0174979 | A1 * | 11/2002 | Haegele | F28D 1/0391 165/177 |
| 2004/0094398 | A1 | 5/2004 | Karoliussen | |
| 2004/0206486 | A1 | 10/2004 | Whittenberger | |
| 2005/0199380 | A1 | 9/2005 | Thyrum et al. | |
| 2008/0072425 | A1 | 3/2008 | Whittenberger et al. | |
| 2008/0085437 | A1 | 4/2008 | Dean et al. | |
| 2009/0229804 | A1 | 9/2009 | Zebuhr | |
| 2018/0038658 | A1 * | 2/2018 | Eplee | F28D 9/0087 |

FOREIGN PATENT DOCUMENTS

| | | | |
|---|---|---|---|
| EP | 0 909 928 | A1 | 4/1999 |
| GB | 512689 | A | 9/1939 |
| GB | 2 190 481 | A | 11/1987 |
| NO | 316475 | B1 | 1/2004 |
| NO | 334102 | B1 | 12/2013 |
| WO | 95/030867 | A1 | 11/1995 |
| WO | 2004/065874 | A1 | 8/2004 |
| WO | 2004/065876 | A1 | 8/2004 |
| WO | 2007/032891 | A2 | 3/2007 |
| WO | 2012/033411 | A1 | 3/2012 |

OTHER PUBLICATIONS

Written Opinion of the International Searching Authority issued in PCT/IB2015/054070 dated Sep. 18, 2015 (5 pages).
Written Opinion of the International Preliminary Examining Authority issued in PCT/IB2015/054070 dated May 19, 2016 (4 pages).
International Preliminary Report on Patentability from PCT/IB2015/054070 dated Oct. 10, 2016 (18 pages).
Norwegian Search Report issued in Patent Application No. 20140674 dated Dec. 19, 2014 (2 pages).
Foerster, S. et al.; "Compact Metallic and Ceramic Recuperators for Gas Turbines"; ASMA paper, No. 78, Jan. 1, 1978, pp. 1-12, XP0080138480 (12 pages).
Search Report issued in Singaporean Application No. 11201609821X, dated Sep. 11, 2017(2 pages).
Search Report issued in Chinese Application No. 2015800287057, dated Nov. 30, 2018 (2 pages).

* cited by examiner

DEVICE FOR HEAT EXCHANGE

BACKGROUND

The present invention relates to a sheet material for heat exchange between fluids in order to cause phase change in the fluids.

Heat exchangers and evaporators are used today as standard equipment for efficient heating or cooling, heat recovery, condensation and evaporation. Heat exchangers and/or evaporators may be of different types and designs, depending on, inter alia, what type of medium is to be heated or cooled, requirements to be met, available space etc.

The efficiency of the heat exchanger or evaporator, i.e., its ability to transfer the heat between the two media that are to be "heat-exchanged" will be highly dependent on how clean the surface of a barrier separating the two media is. In many applications of heat exchangers or evaporators, the media employed, for example, sea water, will cause a soiling of the barrier surface, as a result of biological fouling, deposits, physical particles or the like, this soiling substantially reducing the efficiency of the heat exchanger over time. This will mean that after being in use for some time, and when the heat transfer capacity approaches a specific minimum level, the heat exchanger will require cleaning.

In the marine sector or industry, heat exchangers are used for cooling, inter alia, the propulsion machinery of a vessel etc., where sea water is used as "cooling medium". Here, the cleaning of heat exchangers will be both critical and absolutely essential in order to maintain the vessel's required propulsive power. Such heat exchangers or, in a further developed form, evaporators, can also be used in desalination of sea water, for providing drinking water etc.

WO 95/30867 A1 and NO 316475 B1 describe heat exchanger elements and the manufacture thereof, where it is known that the heat exchanger elements consist of a sheet that is folded to form a plurality of spaces or slits, the sheet separating fluids that are to be heat exchanged, each fluid flowing in slits on each side of the sheet.

A heat exchanger according to the present invention should be understood to mean devices that can be used for heat exchange with and without evaporation. A typical device for heat exchange with evaporation will be an evaporator.

EP 909.928 A1 relates to a heat exchanger unit that is used in connection with heat recovery in a building or house, where a plurality of folded sheets are arranged in a housing, so as to form the heat exchange unit.

GB 512.689, US 2004/0206486 A1 and US 2009/0229804 A1 teach further embodiments of heat exchangers and heat exchanger elements.

A common feature of the aforementioned heat exchangers and heat exchanger units is that after being in use for some time they will have to be cleaned, which means that the heat exchanger or heat exchanger unit must be dismantled, the various elements cleaned and then reassembled.

SUMMARY OF DISCLOSURE

An object of the present invention will therefore be to try to solve one or more of the aforementioned problems or disadvantages.

Another object of the present invention will be to provide a sheet material for heat exchange between fluids, thus inducing a phase change in the fluids, where the heat exchange efficiency of the sheet material over time is reduced to a less extent.

Yet another object of the present invention will be to provide a sheet material for heat exchange between fluids, thus inducing a phase change in the fluids, which is maintenance friendly.

These objects are obtained with a sheet material for heat exchange between fluids, thus inducing a phase change in the fluids, as disclosed in the following independent claim, and where additional features of the invention are set forth in the dependent claims and the description below.

Phase changes in the fluids can increase the degree of soiling substantially compared with ordinary heat exchange between fluids, and the present invention is of major importance for use as evaporator.

The sheet material for heat exchange between fluids, thus inducing a phase change in the fluids, according to the present invention can conceivably be used in a number of fields, in particular in connection with distillation, in so-called MED (Multi Effect Distillation), MED/TVC (Multi Effect Distillation/Thermal Vapour Compression) and/or MVC (Mechanical Vapour Compression) processes and/or systems.

The present invention relates to a sheet material for heat exchange with phase change in a first fluid and a second fluid, the sheet material being suitably folded to form a plurality of slits extending in the longitudinal direction of the folded material, which slits form the flow paths of the fluids, the slits for a second fluid, for example, liquid, in at least one area of the sheet material, through at least one seal, being fully or partly open for through-flow of the liquid.

The slits for the first fluid, for example, steam, can in one or more areas of the folded sheet material, be closed off to through-flow of the steam by means of at least one seal.

The sealing of a slit according to the present invention should be understood to mean that the slit is made tight or closed such that a fluid is unable to flow or move across this sealing or closing. The sealing can, for example, be obtained by moulding, in that one short side of the folded sheet material is placed in a mould, after which a material that is to form an end seal is added to the mould. When the material has hardened, the folded sheet material is turned and the same process is repeated for the other short side of the sheet material. A person of skill in the art will understand that similar seal(s) can also be provided in other areas of the longitudinal direction of folded sheet material, this or these areas being arranged between the end seals.

It should be understood, however, that such an end seal and/or sealing could also be obtained in other ways, for example, by welding, soldering etc. of the slits. A person of skill in the art will know how this should be done, and it is therefore not described in more detail here.

Sealing only the slits for the first fluid, for example, steam, whilst the slits for the second fluid, for example, liquid, remain fully or partly open for through-flow of the liquid, will result on the one hand in the first and second fluid being prevented from commingling when the folded sheet material is arranged in, for example, an element, a housing or a receptacle, and on the other hand in that a remainder of the second fluid can be drained out of the folded sheet material, such that heavy particles and/or concentrate from the second fluid does not remain in the slits in the folded sheet material. This will in turn mean that the folded sheet material will not require as much cleaning and maintenance, whilst the heat exchanger capacity of the folded sheet material is reduced to a less extent.

In an embodiment of the present invention, the sheet material can be so configured, when arranged horizontally, that each slit for the second fluid will form a closed "bottom"

in the folded sheet material, whilst each slit for the first fluid will form a closed "top" in the folded sheet material.

The sheet material can be made of any suitable material.

When the sheet material is folded, the slits will have a width and a height, where the ratio between slit width and slit height is preferably less than 0.15.

A sheet material may, for example, have a length of 10 m and a width of 1 m before it is folded.

When the sheet material is folded to form a plurality of slits, it may however be unstable and it is therefore preferable that it be stiffened.

This stiffening of the sheet material may be obtained, for example, in that the sheet material over at least a part of its length and width is configured with a plurality of stamped portions, which stamped portions are separated from each other by a non-stamped portion. The stamped portions will thus form the walls of the slits in the folded sheet material, whilst the non-stamped portions form the fold (i.e., the closed tops and bottoms of the slits) in the sheet material, the sheet material then being folded about each of the non-stamped portions.

That the sheet material is stamped should be understood to mean that the surface of the sheet material is subjected to an external force that will change the shape (projection/depression) of the sheet material. The stamping may be in the form of continuous or discontinuous furrows or flutes, dots or also a combination thereof.

However, it should be understood that the stiffening of the folded sheet material could also be obtained in other ways, for example, by arranging one or more spacers between one or more of the slits of the folded sheet material.

The aforementioned stiffening means will have the effect of giving the folded sheet material a desired stiffness over the whole or parts of the surface of the folded sheet material.

Although the slits in the folded sheet material are preferably configured as plane surfaces, it should be understood that the slits may also be configured as part circles, arcs or the like.

The sheet material in the open element is made of suitable materials, the sheet material preferably having a thickness of 0.4 mm-0.6 mm. Furthermore, the distance between each slit in the folded sheet material can preferably be 2.5 mm-3.5 mm, more preferably 2.0 mm-3.0 mm.

The folded sheet material according to the present invention can, for example, be arranged in an element, in which the folded sheet material is arranged between at least one holding plate configured in each of a top part and a bottom part of the element. The top and bottom part can further be configured with a central open area for receiving and positioning of the folded sheet material, where the top and the bottom part, on a side of or on the outside of the open central area, can further be configured with an opening for inlet of the first fluid, for example, pressurised steam, and on the opposite side of the open central area are configured with an opening for an outlet of the second fluid, for example, an evaporated liquid. In addition, the top and the bottom part can be configured with at least one through hole on each side of the central open area, the at least one through hole forming an inlet for a fluid and the other at least one through hole forming an outlet for condensed steam.

The top and the bottom part of the element can be connected to each other using suitable connecting means, for example, bolts, screws or the like, so as to provide an assembled element.

A plurality of gaskets etc. may further be arranged between the top part or bottom part of the element and the folded sheet material and/or between the top and the bottom part of the element.

In the bottom part of the element, in an embodiment, a channel or groove may be formed that extends in the transverse direction of the bottom part, which channel or groove is connected to one of the through holes in the element. The channel or groove can then be used to collect a fluid, for example, a residual liquid, which can be drained out of the folded sheet material, this residual liquid being passed further to the through hole and away from the element through the through hole.

An opening and closing device can further be connected to the channel or groove and the through hole, where the opening and closing device can be connected to a control or operating device. When sufficient residual liquid has collected in the channel or groove, the control or operating device will open the opening and closing device, so as to allow the collected residual liquid to be led away from the element in that it opens for through-flow through the through hole.

In order to further stiffen the folded sheet material, a plurality of transverse elements can be arranged across the width of the top and/or bottom frame.

To obtain a proper flow of a fluid across the element, a plate may further be suitably connected to the transverse elements, such that the fluid is "forced" to flow though the slits in the open element.

The folded sheet material according to the present invention, when arranged in an element, can also be used in a modular system, where the modular system may comprise two or more end plates, one of the end plates being configured with at least one inlet and an outlet for fluid, where the modular system may further comprise a plurality of elements arranged one above the other, a plate dividing two adjacent elements, which plate at each end being configured with an opening, where the openings are aligned with the openings for inlet and outlet in the elements when the modular system is assembled.

The number of elements that is arranged between the two end plates can vary, for example, four elements may be arranged between the end plates, but it should be understood that both a larger and a smaller number of elements could be used in a modular system of this kind.

On assembly of the modular system for heat exchange between fluids, thus inducing a phase change in the fluids, a desired number of elements will be arranged one above the other between the two end plates. The end plates will then be brought towards each other, after which suitable fastening devices, e.g., bolts, screws etc., are used to assemble the end plates and the intermediate open elements.

A person of skill in the art will understand that a modular system can be configured in other ways, for example, without the use of end plates, with the elements arranged side by side etc.

Other advantages and features of the present invention will be seen clearly from the following detailed description, the attached figures and the claims below.

The present invention will now be described in more detail with reference to the figures below.

DETAILED DESCRIPTION

Figure 1:
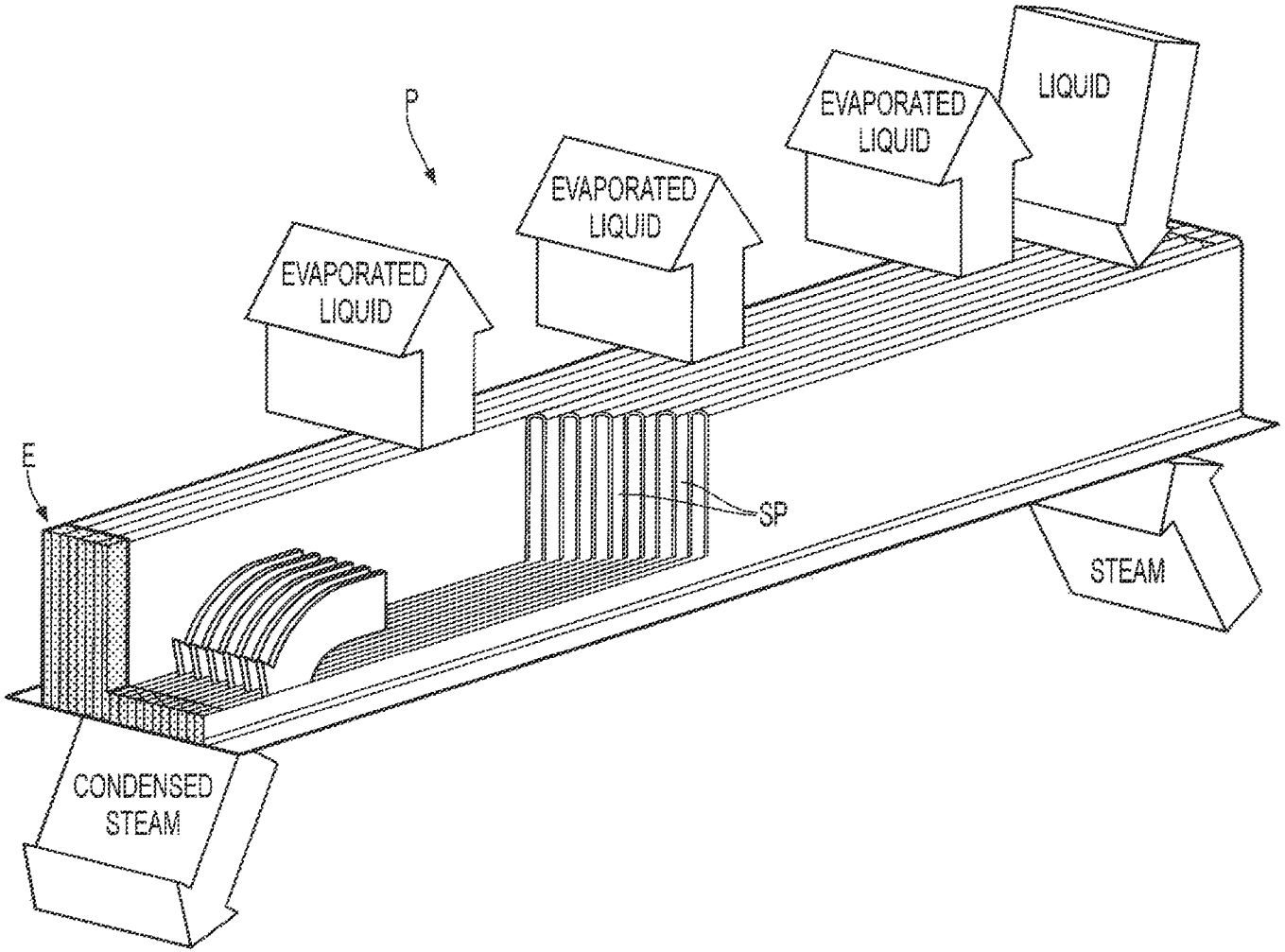
FIG. 1 (Prior Art)
FIG. 1 shows a folded sheet material according to the prior art, where the ends of the folded sheet material are sealed.

FIG. 1 shows a sheet material P for heat exchange between two fluids according to the prior art, where it can be seen that the sheet material P has been folded to form a plurality of slits SP. Such a sheet material P is usually arranged in a housing or receptacle (not shown) configured with one or more inlets and outlets.

The slits SP will form the flow paths of the fluids, such that a first fluid, for example, a liquid, that is delivered on the upper side of and at an end of the folded sheet material P, will be able to move towards an opposite end of the folded sheet material P. Similarly, a second fluid, for example, steam, that is delivered on the underside of and at the same end as the liquid, will also be able to move towards an opposite end of the sheet material P. Each of the ends of the folded sheet material P is sealed with an end seal E, such that when the folded sheet material is arranged in a housing or a receptacle (not shown), the fluid flowing on the upper side of the folded sheet material P will be isolated from the fluid flowing on the underside of the folded sheet material P.

When a sheet material P of this kind is used for heat exchange between a liquid and steam, to provide a phase change in the liquid and the steam, the liquid that is delivered on the upper side of the sheet material P, and which lies in the slits SP, through the sheet material P, will come into "thermal contact" with steam that is delivered on the underside of the sheet material P, and which rises in the slits SP. As the liquid is heated by the steam, the liquid will evaporate from the slits SP over the length of the sheet material P, which evaporation is shown by means of arrows. However, on evaporation of the liquid, heavy particles and concentrate in or from the delivered liquid will remain in the bottom of the slits SP, causing the effect of the sheet material to be substantially reduced over time. Therefore, after being in use for some time, and when the heat transfer capacity is approaching a specific minimum level, a folded sheet material of this kind will have to be cleaned.

The steam that is delivered on the underside of the sheet material 1, will over the length of the sheet material 1, emit so much heat to the liquid on the upper side of the sheet material 1 that the liquid evaporates, whilst the steam delivered on the underside of the sheet material will gradually be condensed. The condensed steam can then be carried away from the sheet material 1 at an opposite end to where the steam was delivered to the sheet material 1.

Figure 2:
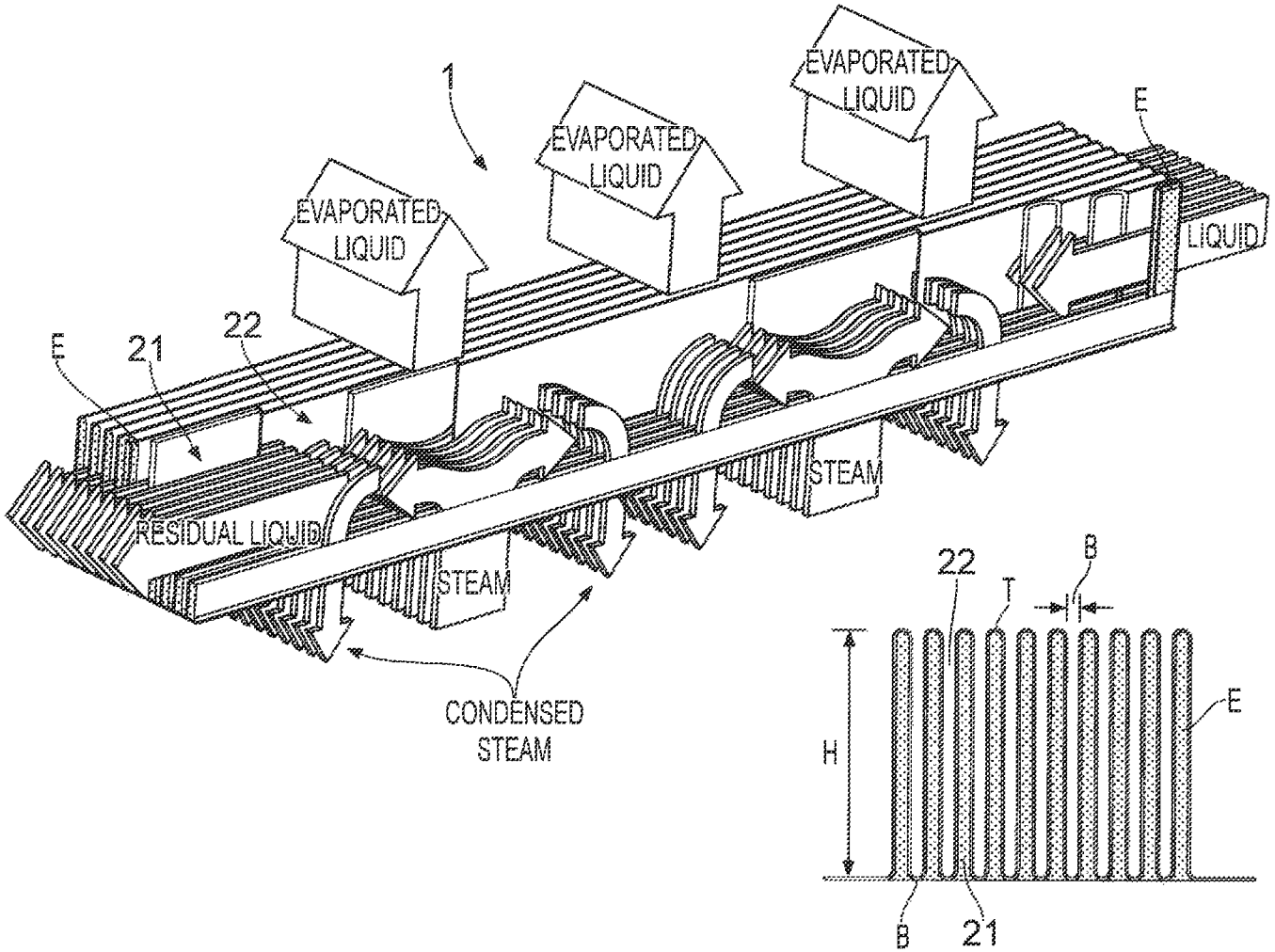
FIG. 2 shows an embodiment of a sheet material for heat exchange between fluids, thus inducing a phase change in the fluids, according to the present invention.

FIG. 2 shows an embodiment of a sheet material 1 for heat exchange between fluids, thus inducing a phase change in the fluids, according to the present invention, where the sheet material 1 is folded to form a plurality of slits 21, 22 in the sheet material 1. The slits 21 form flow paths for a first fluid, for example, a (pressurised) steam, whilst the slits 22 form flow paths for a second fluid, for example, a liquid. Each slit 22 will further be so configured that it will be closed at a bottom B of the slit 22. Similarly, each slit 21 will be configured closed at a top T of the slit 21. At each end of the sheet material 1, the slits 21 are sealed by an end seal E, with the result that the first fluid cannot be delivered or flow out through the short sides of the sheet material 1. The slits 22, however, are not sealed but are fully open, whereby the second fluid can be delivered through one of the short sides of the folded sheet material 1, and be drained out of the other and opposite short side of the folded sheet material 1.

The second fluid, for example, a liquid, can then be delivered to an upper side of the folded sheet material 1 through one of the short sides of the folded sheet material 1, as shown by the arrow, and move towards an opposite short side through the slits 22, from which slits 22 the liquid will also evaporate, when the liquid, via the folded sheet material 1, is brought into thermal contact with a first fluid, for example, a pressurised steam, which is in the slits 21.

As the slits 21, at both ends of the sheet material 1, are sealed by the end seals E, the pressurised steam will be delivered on an underside of the sheet material 1, as shown by the arrows. The pressurised steam will then fill the slits 21 between the end seals E and be heat exchanged with the liquid that is in the slits 22. The heat exchange with the liquid will result in most of the pressurised steam being condensed and running down from the slits 21.

The liquid will be delivered on the same side (i.e., through one of the short sides) of the folded sheet material 1 as that on which the pressurised steam was delivered, but the liquid will be able to "flow" substantially horizontally into the folded sheet material 1 through the slits 22, as the slits 22 are not end-sealed, or are only partly end-sealed.

Through its movement towards the opposite side to its delivery, most of the liquid will, as a result of heat exchange with the pressurised steam, evaporate as shown by arrows, where a residual liquid, i.e., the liquid that has not been evaporated over the length of the folded sheet material 1, can be drained out of the folded sheet material 1 at an opposite end to where the liquid was introduced, the slits 22 at this end of the folded sheet material 1 also not being, or being only partly sealed by an end seal E.

By configuring the folded sheet material 1 only with the slits 21 sealed by an end seal E, i.e., the slits 21 carrying the pressurised steam, the residual liquid that has not evaporated over the length of the folded sheet material 1 can be drained or withdrawn at an opposite end to where the liquid was delivered, resulting in heavy particles and concentrate in and from the delivered liquid not remaining or remaining to a far less extent in the bottom B and on the walls of the slits 22.

Through such a configuration, the heat transfer capacity of the folded sheet material 1 will not be reduced, or will be reduced to a far less extent, thereby also reducing the need for cleaning and maintenance of the folded sheet material 1. If the folded sheet material 1 must for some reason nevertheless be cleaned and/or maintained, this can be done without having to remove the folded sheet material 1 from the housing or receptacle (not shown) in which it is arranged. Suitable liquid and/or liquid at pressure can then be run through the housing or receptacle in which the folded sheet material 1 is arranged, whereby any heavy particles and/or brine remaining in the bottom of the slits 22 of the folded sheet material 1 will then be removed.

FIG. 2 also shows a cross-section of one short side of the folded sheet material 1 and the end seal E provided therein, where it can be seen that only the slits 21 in the folded sheet material 1 are sealed. The slits 22 will be open over the entire length and width of the folded sheet material 1, such that residual liquid can be "drained" out of the folded sheet material 1.

Figure 3:
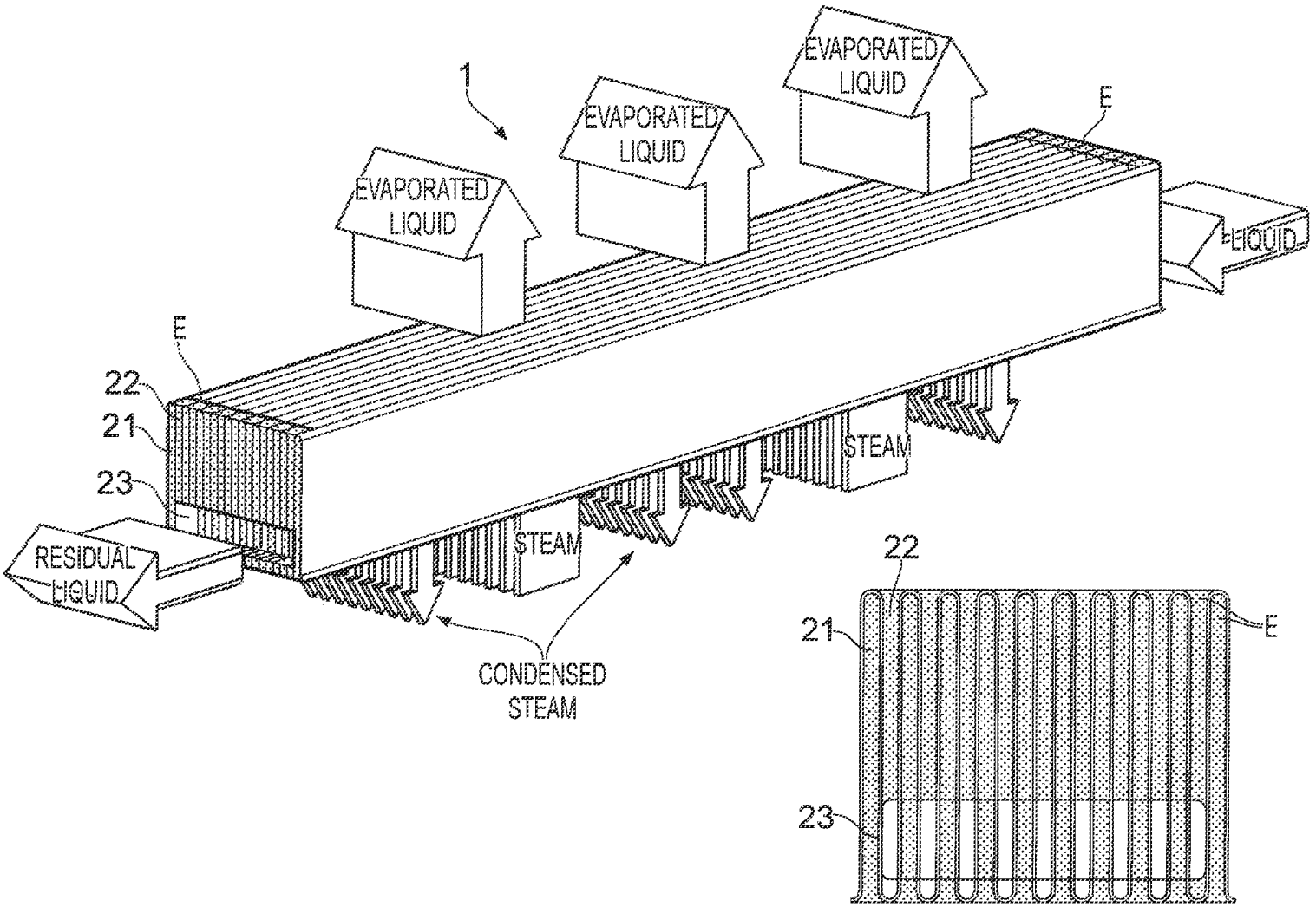
FIG. 3 shows an alternative embodiment of a sheet material for heat exchange between fluids, thus inducing a phase change in the fluids, according to the present invention.

FIG. 3 shows an alternative embodiment of a sheet material 1 for heat exchange between fluids, thus inducing a phase change in the fluids, according to the present invention, where the sheet material 1, in a way similar to that explained in relation to FIG. 2, is folded to form a plurality of slits 21, 22 in the sheet material 1.

A first fluid, for example, a liquid, will be delivered to an upper side of the folded sheet material 1 through one short side of the folded sheet material 1 and will move towards an opposite short side of the folded sheet material 1 through the slits 22. The liquid will evaporate when the liquid, through the sheet material 1, is brought into contact with a second fluid, for example, a pressurised steam, which will flow up into the slits 21 from the underside of the folded sheet material 1.

The slits 21, 22 at both ends of the folded sheet material 1 are sealed by an end seal E, but in a lower area 23 of the end seal E, the sealing of the slits 22 has been removed, thereby allowing liquid, through the open slits 22 in the area 23, to flow into the folded sheet material 1 at one end of the folded sheet material 1, and out of the folded sheet material 1 at an opposite end.

The end seal E which is not shown fully in the figure (i.e., the end seal that is on the far right in the figure) can be configured in the same way as the end seal E that is shown (i.e., the end seal that is on the far left in the figure). The end seal E can also be configured such that the slits 22 are not sealed, but are fully open, as explained for the end seal E in relation to FIG. 2.

In a similar way as explained in relation to FIG. 2, pressurised steam will be passed into the folded sheet material 1 on an underside of the folded sheet material 1, as is shown by the arrows. The pressurised steam will then fill the slits 21 between the end seals E, so as to be heat exchanged with the liquid, which is passed on the upper side of the folded material 1, in the slits 22. The heat exchange between the pressurised steam and the liquid will result in most of the pressurised steam condensing. The condensed steam will then be collected on the walls of the slits 21 and run down from them.

On the upper side of the folded sheet material 1, liquid will be able to flow substantially horizontally into the folded sheet material 1 through the lower area 23 of the end seal E and the slits 22, as the slits 22 are not end-sealed. Through its movement towards the opposite side of the sheet material 1, a major portion of the liquid will evaporate, as shown by arrows, and a residual liquid, i.e., the liquid that has not been evaporated over the length of the folded sheet material 1, can be drained out of the folded sheet material 1 at an opposite end to where the liquid was introduced, through the lower area 23, the sealing of the slits 22 in the lower area 23 of the end seal E having been removed.

Configuring the end seal E with a lower area 23, where the slits 22 carrying the liquid are not sealed, will enable the residual liquid that has not evaporated over the length of the folded sheet material 1 to be drained out or withdrawn at an opposite end to where the liquid was delivered, resulting in heavy particles and concentrate in and from the delivered liquid not remaining or remaining to a far less extent in the bottom and/or on the walls of the slits 22.

Through such a configuration, the folded sheet material 1 will not lose its heat transfer capacity, and the need for cleaning and maintenance is reduced. If the folded sheet material 1 for some reason must nevertheless be cleaned and/or maintained, this can be done without having to remove the folded sheet material 1 from the housing or receptacle (not shown) in which it is arranged. Suitable liquid or liquid at pressure can then be run through the housing or the receptacle in which the folded sheet material 1 is arranged, whereby any heavy particles and/or concentrate remaining in the bottom or on the walls of the slits 22 will then be removed.

The figure also shows a cross-section of the end seals E, where it is evident that in the area 23 of the end seal E the slits 21 are sealed, whilst the slits 22 are open, such that the liquid can be drained out of the folded sheet material 1 through the area 23. Over the rest of the end seal E, the slits 22 will also be sealed.

The area 23 in the end seal E can be provided by first moulding the end seal E, such that both slits 21, 22 are sealed, but where the slits 21 have been given a deeper seal, after which the material in the slits 22 is in a suitable manner removed from the area 23, or by providing the area 23 already during moulding of the end seal E.

Figure 4:
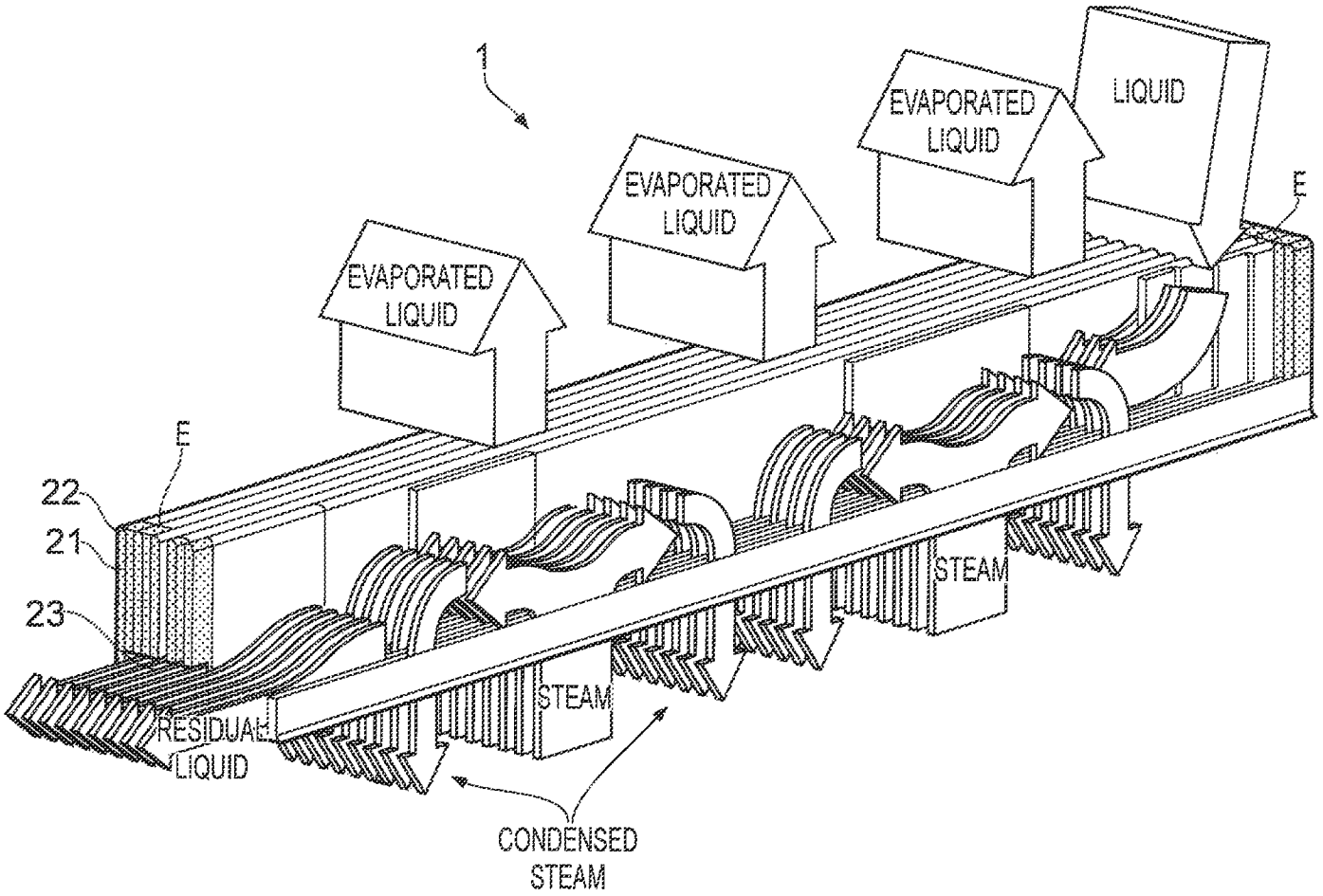
FIG. 4 shows an alternative embodiment of a sheet material for heat exchange between fluids, thus inducing a phase change in the fluids, according to the present invention.

FIG. 4 shows another alternative embodiment of a sheet material 1 according to the present invention, where the sheet material 1 is folded to form a plurality of slits 21, 22 in the sheet material 1.

In this embodiment, the slits 21, 22 in an end of the folded sheet material 1, i.e., the end on the far right in the figure, will be sealed with an end seal E which covers or seals both the slits 21, 22. At an opposite end, i.e., the end on the far left in the figure, the slits 21, 22 will be sealed by an end seal E, where the sealing of the slits 22 in a lower area 23 of the end seal E will be removed, as is explained in relation to FIG. 3, such that a fluid, for example, a liquid, can be drained out of the folded sheet material 1 through the area 23 and the open slits 22.

Liquid will be delivered to an upper side of the folded sheet material 1, as is shown by the arrow. The liquid will then be deflected by the end seal E and move in the longitudinal direction of the folded sheet material 1, towards an opposite end. Over the length of the folded sheet material 1, a major portion of the liquid will evaporate, as shown by arrows, owing to heat exchange with a second fluid, for example, a pressurised steam. A residual liquid, which has not evaporated, can then be drained at an opposite end to where the liquid was delivered, through the lower area 23 of the end seal E, the slits 22 in the lower area 23 being open.

The pressurised steam will be delivered to the folded sheet material 1 on an underside of the folded sheet material 1, as shown by the arrows. The pressurised steam will then fill the slits 21 between the end seals E and be heat exchanged with the liquid that is on the upper side of the folded sheet material 1, in the slits 22. The heat exchange between the liquid and the steam will result in most of the steam condensing, whereby the condensed steam will run down from the slits 21.

Figure 5:
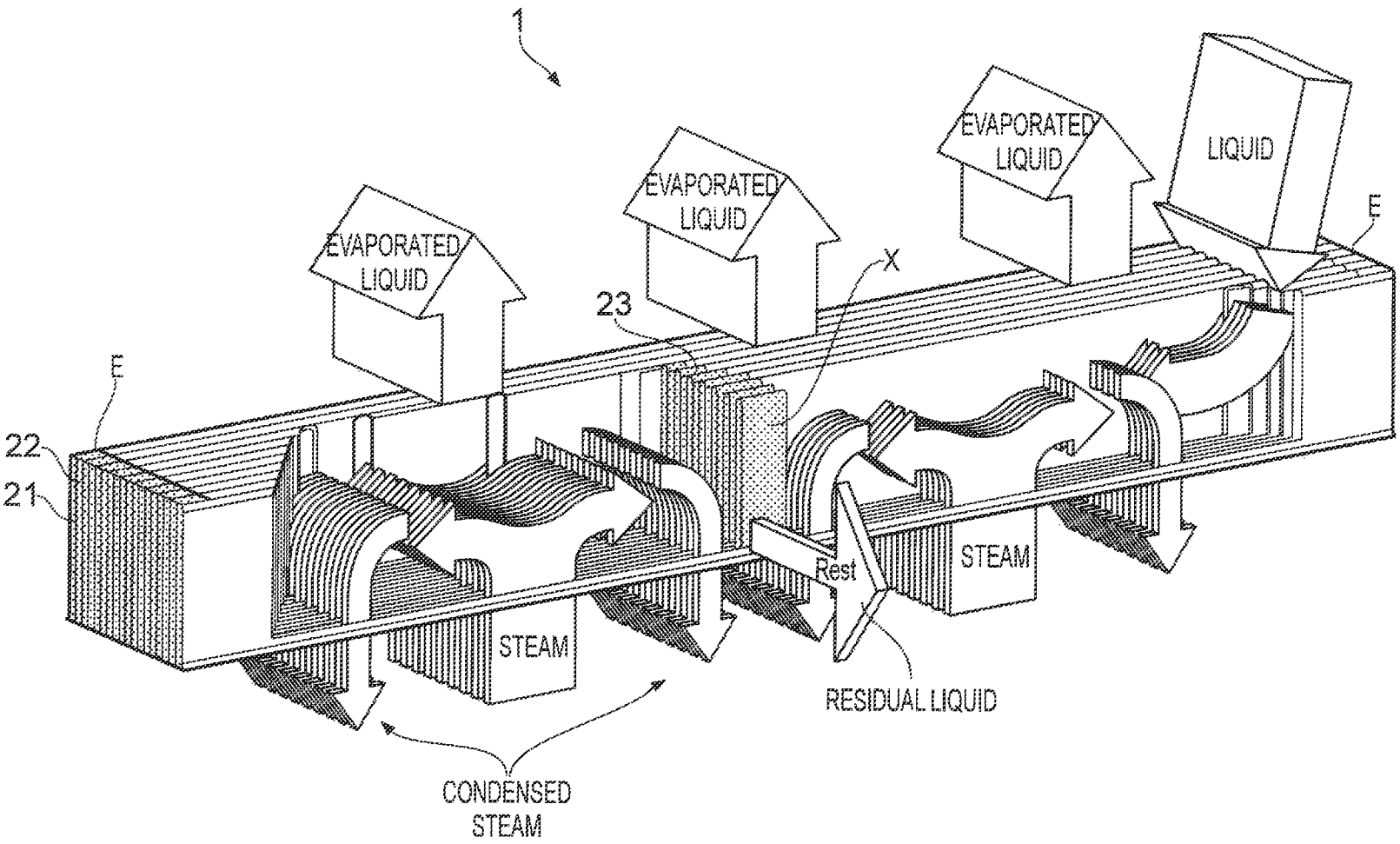
FIG. 5 shows an alternative embodiment of a sheet material for heat exchange between fluids, thus inducing a phase change in the fluids, according to the present invention.

FIG. 5 shows an alternative embodiment of the sheet material 1 according to the present invention, where the sheet material 1 is folded to form a plurality of slits 21, 22 extending in the longitudinal direction of the sheet material 1. A first fluid, for example, a liquid, can then be delivered on the upper side of the folded sheet material 1, for example, in an area in proximity to one of the short sides of the folded sheet material 1, and where the liquid will then be able to move towards an opposite short side of the folded sheet material 1. During its movement in the longitudinal direction of the folded sheet material 1, the liquid will also evaporate from the slits 22 through the liquid being brought into contact with a second fluid, for example, a pressurised steam, which is delivered on the underside of the folded sheet material 1.

The folded sheet material 1 is sealed at both its ends by an end seal E, thus sealing the slits 21, 22. However, the slits 21 are also sealed with an additional seal X arranged between the two end seals E, where the seal X can, for example, extend 3-7 cm in the longitudinal direction of the folded sheet material 1.

A lower area 23 of the seal X has however been removed, as explained in relation to the end seal in FIG. 3, such that the slits 21 will be sealed, whilst the slits 22 will be open. Such a seal X could be provided by embedding a seal in the slits 21, positioned anywhere between the end seals E. In the seal X, some material can thus be removed in the middle lower part of the seal X, such that the slits 21 remain intact, whilst the slits 22 are opened for a possible draining. Such an opening of the slits 22 can give a draining where the residual liquid will preferably be withdrawn on one side or the other of the element. By using such an arrangement, the steam for the slits 21 will have to be delivered on both sides of such a seal X, as this seal divides the slits into two independent areas.

In this embodiment, a first fluid, for example, a liquid, will be delivered to an upper side of the folded sheet material 1 for heat exchange between fluids, thus inducing a phase change in the fluid, as is shown by the arrow. The liquid will then be deflected by the end seal E and move in the longitudinal direction of the folded sheet material 1, towards an opposite end. As the liquid is brought into contact with a second fluid, for example, a pressurised steam, most of the liquid will evaporate over the length of the folded sheet material 1, as shown by arrows. A residual liquid, which has not evaporated, can then be drained out through the seal X, transverse to the longitudinal direction of the sheet material 1, through the lower area 23 of the seal X, the slits 22 in the lower area 23 of the end seal X being open.

The pressurised steam will be delivered to the folded sheet material 1 on an underside of the folded sheet material 1, as is shown by the arrows.

The pressurised steam will then fill the slits 21 between the end seals E, X and be heat exchanged with the liquid that is on the upper side of the folded sheet material 1, in the slits 22.

Figure 6:
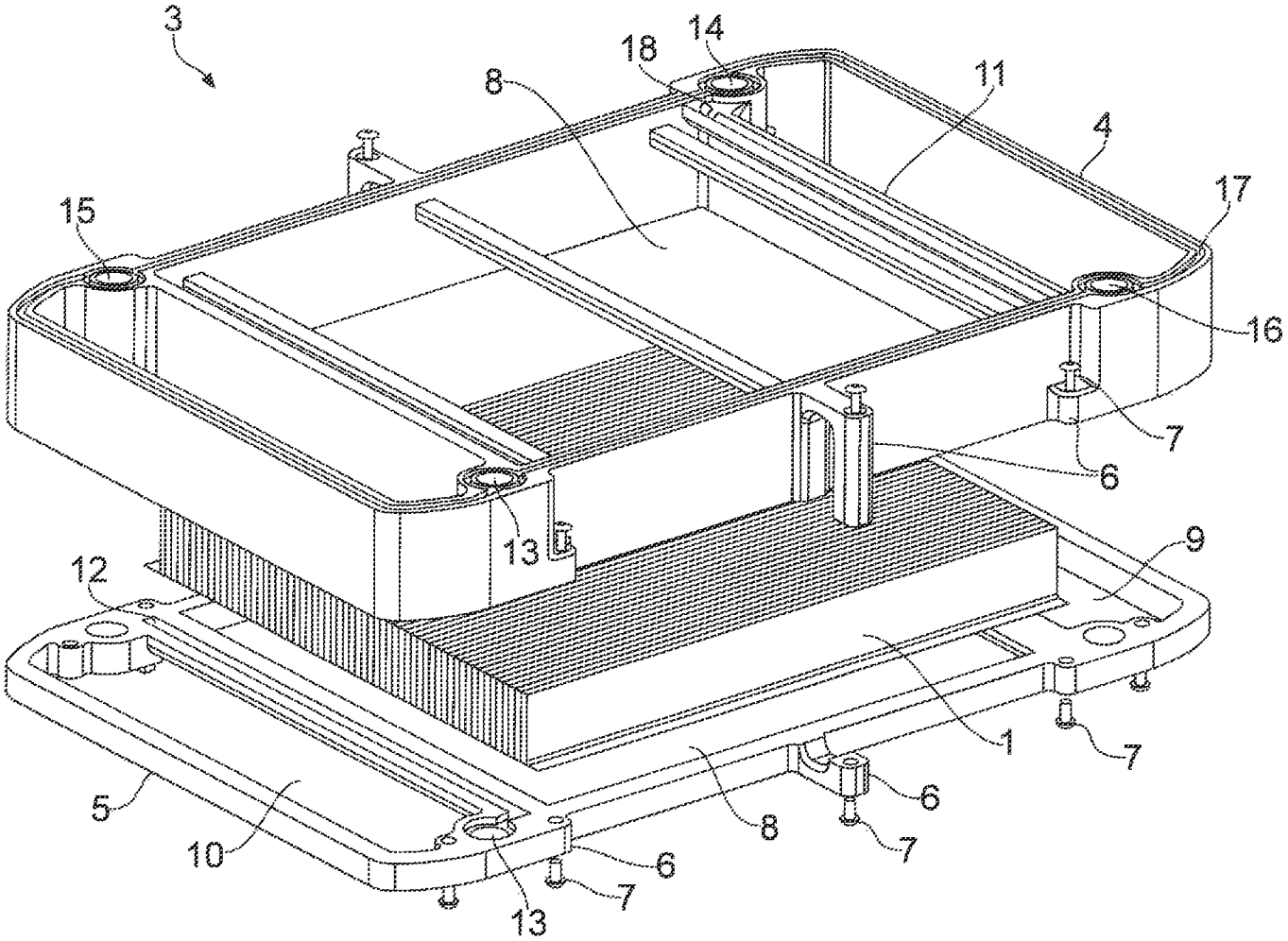
FIG. 6 shows an element that is in the process of being assembled, where a sheet material for heat exchange between fluids, thus inducing a phase change in the fluids, according to one of the embodiments shown in FIGS. 2-5 is arranged in the element.
Figure 8:
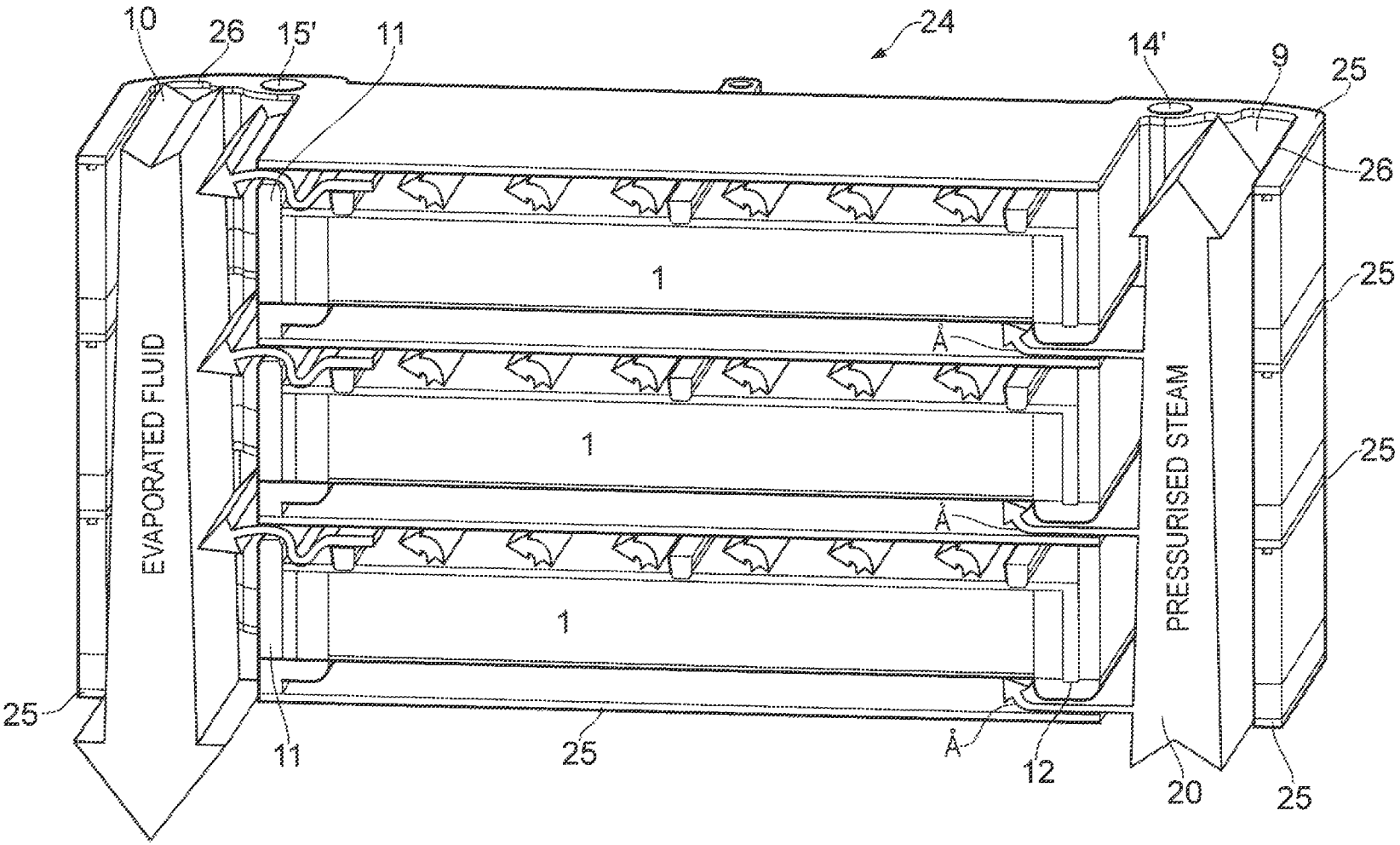
FIG. 8 shows a cross-section of a part of a modular system when assembled, the modular system comprising a plurality of elements according to FIG. 6 or 7.
Figure 9:
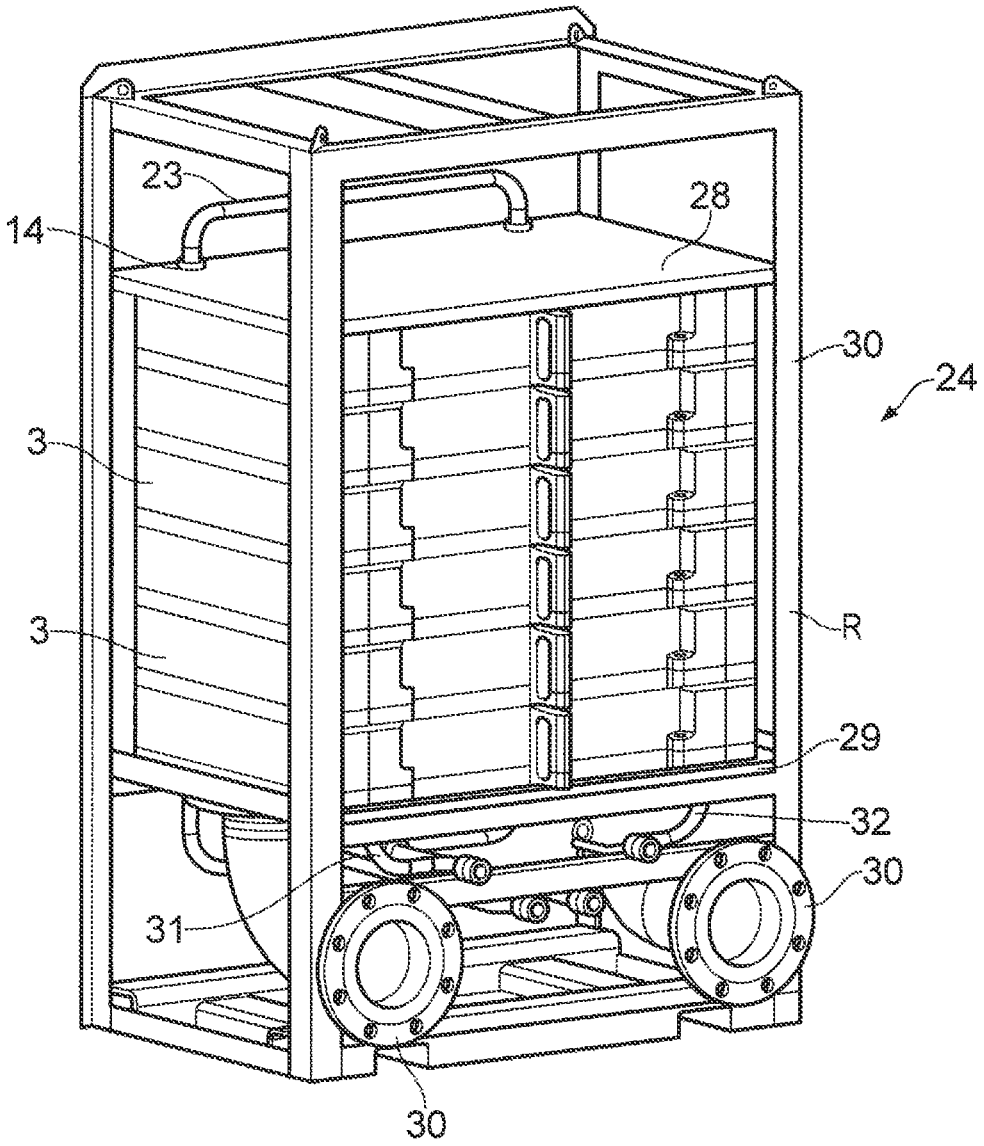
FIG. 9 shows a modular system fully assembled.

FIG. 6 shows an element 3 for heat exchange between fluids, in which element 3 the folded sheet material 1 described in relation to the embodiments shown in FIGS. 2 to 5 can be arranged, where the element 3 is in the process of being assembled. A plurality of such elements 3 can be assembled in a modular system 16, as is shown in FIGS. 8 and 9.

The element 3 comprises a top part 4 and a bottom part 5, where around the periphery of the top and the bottom part 4, 5 is provided a plurality of connecting elements 6 configured with through holes, such that the top and the bottom part 4, 5 can be connected to each other with the aid of bolts, nuts, screws 7 or the like. One of these connecting elements may be configured as a handle, thereby facilitating handling of the element 3.

One or more gaskets (not shown) may be arranged between the top and the bottom part 4, 5.

The top and the bottom part 4, 5 of the element 3 are configured with an open central area 8, which open central area 8 is adapted to receive the folded sheet material 1. The open central area 8 will further have a slightly larger length than the folded sheet material 1, in order, inter alia, to be able to supply a fluid, for example, a liquid, to one end of the folded sheet material 1 and to be able to allow a residual liquid remaining after the liquid has been heat exchanged with a second fluid, for example, a pressurised steam, to be drained out of the folded sheet material 1.

The top and the bottom part 4, 5 are further configured on one side of the open central area 8 with an opening 9 for inlet of pressurised steam and on the opposite side with an opening 10 for evaporated fluid (evaporated liquid). The evaporated fluid will then be able to flow into the opening 10 over a wall 11 in the top part 4, the wall 11 being slightly lower than the frame of the top part 4. Further, the top and the bottom part 4, 5 will be configured with through holes 13, 14, 15, 16, which through holes 13, 14, 15, 16 will be in line with each other when the element is assembled.

The bottom part 5, between the open central open area 8 and the opening 9, is configured with a channel or groove 12 that runs in the transverse direction of the element 3, in which channel or groove 12 a residual liquid from the folded sheet material 1 will run down when the residual liquid flows out of the sheet material 1. The length of the channel or groove 12 will essentially correspond to the width of the folded sheet material 1.

The channel or groove 12 is further connected to a through hole 13 in the bottom frame 5, so as to allow the residual liquid to run down into the through hole 13 and be carried away from the element 3. A similar through hole 13 is configured in the top part 4.

In connection with the channel or groove 12 and the through hole 13 is arranged an opening and closing device (not shown), for example, a valve, flap or the like, which opening and closing device is connected to a control or operating device (not shown) that will open for outflow of the residual liquid from the channel or groove 12 into the through hole 13. The opening and closing device is initially closed, and will be opened as required, for example, when a certain amount of residual liquid has been collected in the channel or groove 12. A person of skill in the art will know how this can be done, and therefore it is not described in more detail here.

The top part 4 is also configured with a through hole 14, this hole 14 forming an inlet for the liquid that is to be heat exchanged with the pressurised steam. The through hole 14 is further configured with an opening, slot or the like 18, to allow the liquid to flow into the open central area 8 and then into the slits 22 of the folded sheet material 1. The liquid will however be delivered to the element 1 via a through hole 15. The through hole 14 will then be connected to the through hole 15 by means of a tube 23 or the like.

A groove 17 is formed around the periphery of the top part 4, in which groove 17 a gasket (not shown) can be arranged. Such a gasket will seal between two superposed elements 3 in the modular system for heat exchange between two fluids, as is shown in FIGS. 8 and 9.

Figure 7:
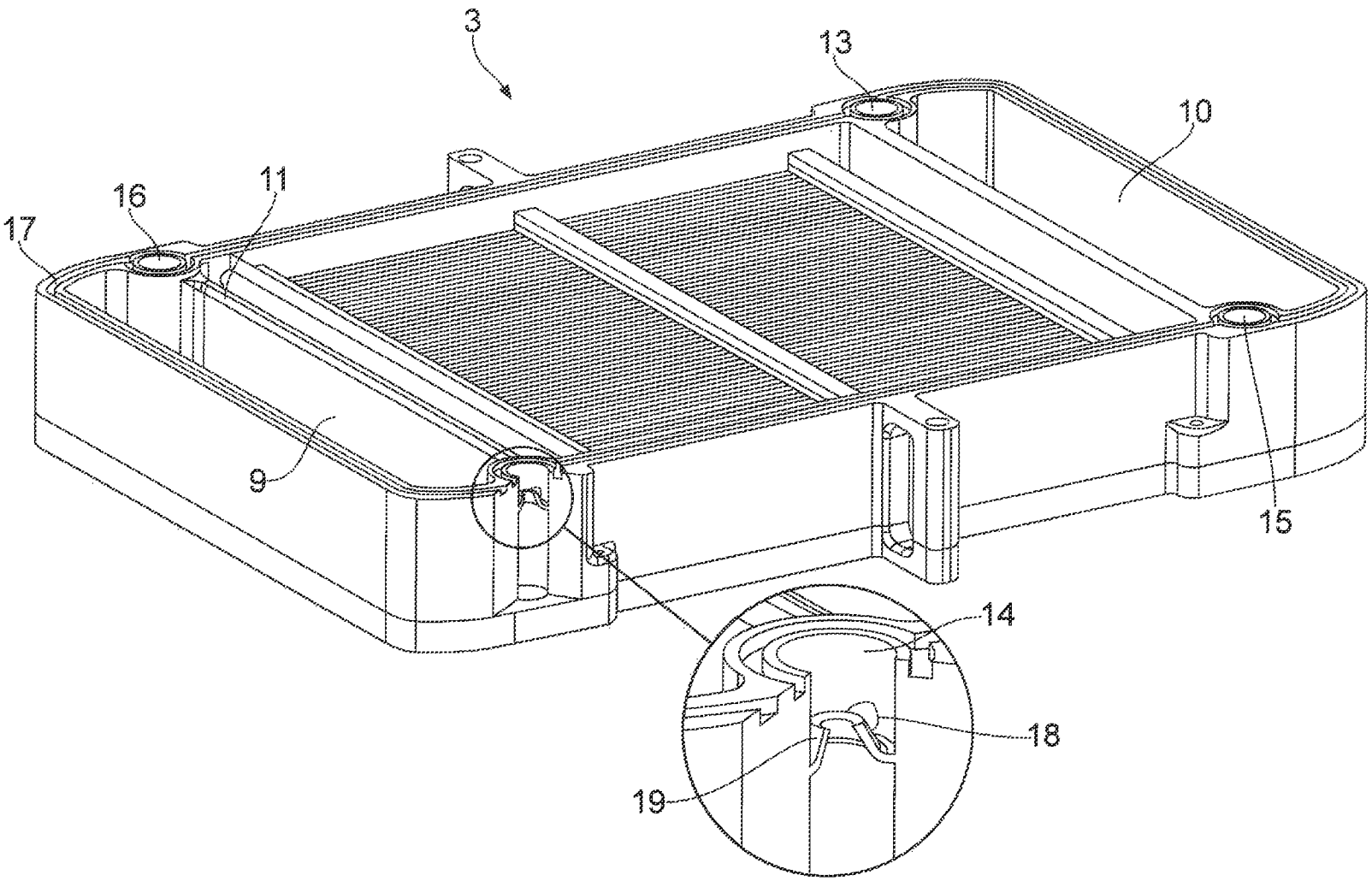
FIG. 7 shows the element according to FIG. 6 fully assembled, and additional details of the element.

FIG. 7 shows the element 3 according to FIG. 5 when assembled. To deliver a liquid on the upper side of the folded sheet material 1, a through hole 15 is used. The through hole 15 will then be connected to the through hole 14 by means of a tube 23. Liquid can then be pumped up through the through hole 15, and further to the through hole 14, so as to be allowed to flow down the through hole 14. As can be seen from the figure, the through hole 14 is configured with at least one opening, slot 18 or the like, which at least one opening 18 will allow liquid that flows down the through hole 14 also to flow out of the through hole 14 and into the open central area 8 of the element 3, so as to be passed into the slits 22 of the folded sheet material 1.

A deflecting means 19 is further arranged on the inside of the through hole 14. The deflecting means 19 is configured such that a portion of the liquid that runs down the through hole will be deflected towards the at least one opening 18, whilst a remaining portion of the liquid is passed down in the through hole 14.

FIG. 8 shows a cross-section of a modular system 24, which modular system 24 comprises three elements 3 that are stacked on top of each other, so as to form a complete evaporator unit.

A plate 25 is arranged between two adjacent elements 3. Towards each end, the plate 25 is configured with an opening 26, the openings 26 being aligned with the openings 9, 10 in the elements 3. The openings 9, 26 will then form an inlet for a first fluid, which fluid may, for example, be pressurised steam, whilst the openings 10, 26 will then form an outlet for evaporated fluid. The plate 25 is also configured with a plurality of through holes 13', 14', 15', 16' (only through holes 14', 15' can be seen), which through holes 13', 14', 15', 16' will be aligned with the through holes 13, 14, 15, 16 in the elements 3 when the modular system is assembled.

As can be seen from the figure, pressurised steam will be delivered to the modular system 24 through the openings 9, 26 and from an underside of the modular system 24, such that the pressurised steam will rise upwards.

The pressurised steam will then be allowed to flow in on an underside of each element 3, in that an opening A is provided between the element 3 and the underlying plate 25.

One or more gaskets are arranged between an overlying plate 25 and the immediately underlying element 3, so as to form a tight connection between them, which means that evaporated fluid from one of the elements 3 will not be able to flow up into the overlying element 3.

Liquid will be delivered to the elements 3 in the modular system 24 by being pumped up through the through holes 15 in the elements 3, to the element 3 that is arranged uppermost in the modular system 24. The through hole 15 is then connected to the through hole 14 through the tube 23, such that the liquid is passed into the through hole 14. As described in relation to FIGS. 6 and 7, the through hole 14 in each element 3 is configured with at least one opening 18, slot or the like, whereby the at least one opening 18, together with the deflecting means 19 arranged in the through hole 14, will lead a portion of the delivered liquid into the open central area 8 in this element 3. The liquid will then be capable of being moved into the slits 22 in the folded sheet material 1.

The deflecting means 19 will, however, be so configured that a portion of the delivered liquid is allowed through it, such that liquid can run down into the through hole 14, to the next element 3, and thence further to yet another element 3, the deflecting device 19 and the opening 18 in each element ensuring that liquid is delivered also to these elements 3.

As explained in connection with FIGS. 2-5, liquid and pressurised steam will be heat exchanged with each other over the length of the folded sheet material 1, where evaporated fluid from each element 3 will flow out to the opening 10, in order then to be passed together to a pressure-increasing means, for example, a blower, a compressor or the like (not shown) in order again to pressurise the evaporated fluid and then feed this pressurised steam back to the opening 9, 26, so as to start a new "heat exchange process". The residual liquid will be drained out of each element 3 as explained in connection with FIGS. 6-7 and will be withdrawn from the modular system, in the bottom thereof, in a suitable way, for example, through a duct that is connected to a lower end plate 29. The pressurised steam will, through the heat exchange with the liquid over the length of the folded element, be condensed, and will be capable of being passed out of each element 3 through the through hole 16 in the elements 3, so as to be collected at the lowermost plate 25 in the modular system. A duct that is connected to the lower end plate 29 will then be able to carry away the condensed steam.

In FIG. 9, the modular system can be seen mounted in a frame R, where it can be seen that the upper end plate 28 is configured with two openings or holes to be able to supply liquid to the elements 3, as described in relation to FIGS. 6-8. It is further seen that the lower end plate 29 is configured with a plurality of openings or holes for discharge of residual liquid and condensed steam and circulation of pressurised steam and evaporated fluid, the openings or holes being connected to ducts 31, 32 and connection pieces 30 for connection to a pressure-increasing means, for example, a blower, compressor or the like.

Figure 10:
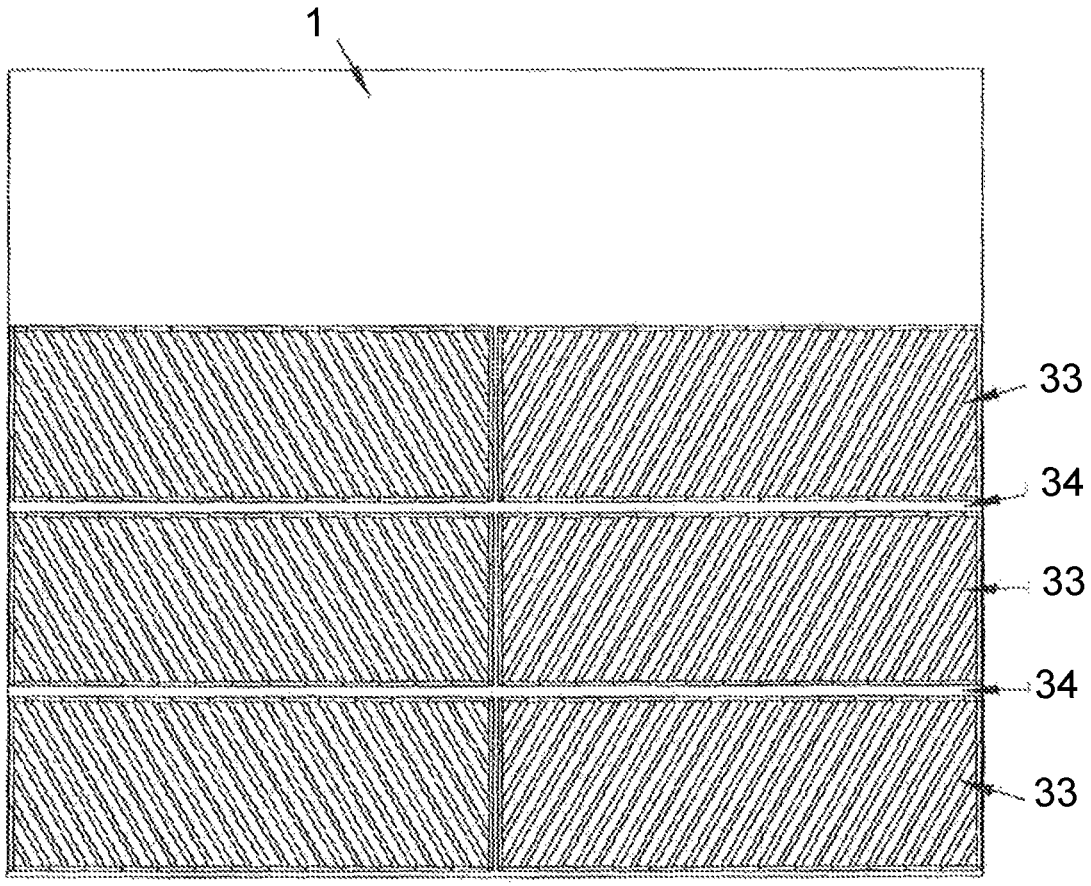
FIG. 10 shows the sheet material for heat exchange between fluids, where the plate material is shown before the plate material is folded.

FIG. 10 shows the sheet material 1 for heat exchange between two fluids, where the plate material is shown before the plate material 1 is folded.

When the sheet material 1 is folded to form a plurality of slits 21, 22, the sheet material 1 may however be unstable, and the sheet material 1 may therefore be stiffened.

This stiffening of the sheet material 1 may be obtained, for example, in that the sheet material 1 over at least a part of its length and width is configured with a plurality of stamped portions 33, which stamped portions 33 are separated from each other by a non-stamped portion 34. The plurality of stamped portions 33 will thus form the walls of the slits 21, 22 in the folded sheet material 1, whilst the non-stamped portions 34 form the fold (i.e., the closed tops and bottoms of the slits 21, 22) in the sheet material 1, the sheet material 1 then being folded about each of the non-stamped portions 34.

The invention has now been explained by several non-limiting exemplary embodiments. A person of skill in the art will, however, understand that a number of variations and modifications can be made to the folded sheet material as described within the scope of the invention as defined in the attached claims.

What is claimed is:

1. A sheet material for heat exchange between liquid and steam to cause phase change in the liquid and steam, wherein the liquid being evaporated and the steam being condensed over a length of the sheet material, comprising:

wherein the sheet material is folded to form a plurality of slits extending in the longitudinal direction of the sheet material, wherein the folded sheet material being arranged horizontally, which slits constitute the flow paths of the liquid and steam, the slits for the liquid being closed at a bottom of the slits for the liquid and the slits for the steam being closed at a top of the slits for the steam, wherein the slits for the steam at each end of the folded sheet material are sealed by an end seal, the slits for the steam thereby being closed off to through-flow of the steam through the end seals, and wherein the slits for the liquid, through at least one seal, are fully or partly open for drainage of a residual liquid of said liquid that has not evaporated over the length of the folded sheet material, the liquid being delivered to an upper side of the folded sheet material and the steam being delivered to an underside of the folded sheet material.

2. The sheet material according to claim 1, wherein walls in the slits are configured as plane surfaces.

3. The sheet material according to claim 1, wherein the sheet material, over at least a part of a length and width of the sheet material, is configured with a plurality of stamped portions, which stamped portions are separated from each other by non-stamped portions.

4. The sheet material according to claim 3, wherein the stamping is in the form of continuous or discontinuous furrows or flutes.

5. The sheet material according to claim 1, wherein the end seal is configured to seal the slits for both the steam and the liquid, the slits for the steam and partly the slits for the liquid, or only the slits for the steam.

* * * * *